US005931635A

United States Patent [19]

Barthold

[11] Patent Number: 5,931,635

[45] Date of Patent: Aug. 3, 1999

[54] DEVICE FOR REMOVING FLAT ARTICLES FROM A STACK

[75] Inventor: Ulrich Barthold, Baltmannsweiler, Germany

[73] Assignee: Eastman Kodak Company, Rochester, N.Y.

[21] Appl. No.: 08/946,440

[22] Filed: Oct. 7, 1997

[30] Foreign Application Priority Data

Jan. 23, 1997 [DE] Germany ..... 197 02 304

[51] Int. Cl.[6] ..... B65G 59/02

[52] U.S. Cl. ..... 414/797.3; 414/796.9; 414/797; 271/18.3; 271/33; 271/94

[58] Field of Search ..... 271/18.3, 33, 119, 271/120, 94; 414/797.3, 797, 797.2, 796.9, 796.5, 796.7

[56] References Cited

U.S. PATENT DOCUMENTS

| | | | |
|---|---|---|---|
| 824,401 | 6/1906 | Baumgartner | 414/797.3 |
| 4,350,466 | 9/1982 | Bahr et al. | 414/797 |
| 4,758,126 | 7/1988 | Johnson et al. | 414/797.3 |
| 5,061,231 | 10/1991 | Dietrich et al. | 414/797 |
| 5,149,077 | 9/1992 | Martin et al. | 271/18.3 |
| 5,489,360 | 2/1996 | Shimizu et al. | 271/120 |
| 5,511,936 | 4/1996 | Goldkuhle | 414/797.3 |
| 5,540,423 | 7/1996 | Nakano | 271/119 |
| 5,775,871 | 7/1998 | Redden | 414/797 |

FOREIGN PATENT DOCUMENTS

| | | | |
|---|---|---|---|
| 0 266 083 | 11/1986 | European Pat. Off. . | |
| 40 01 370 | 7/1991 | Germany . | |
| 42 40 015 | 6/1994 | Germany . | |
| 62-56235 | 3/1987 | Japan | 271/119 |
| 5-270689 | 10/1993 | Japan | 271/119 |
| 1291254 | 2/1987 | U.S.S.R. | 414/797.3 |
| 1233225 | 5/1971 | United Kingdom | 414/797.3 |

*Primary Examiner*—James W. Keenan
*Assistant Examiner*—Douglas Hess
*Attorney, Agent, or Firm*—Lawrence P. Kessler

[57] ABSTRACT

The device for removing flat articles from a stack comprises at least one roller which contacts the uppermost article of a stack and is rotatable about a shaft and whose circumferential surface is covered by a layer consisting of a resilient material. The resilient layer positioned on the circumferential surface of the roller includes a number of suction cups. The roller is designed as a hollow roller which includes a mechanical device by which the suction cups in the resilient layer on the circumferential surface of the roller can be operated by partial deformation of said resilient layer. The suction cups are formed by depressions in the resilient layer on the circumferential surface of the roller, said depressions cooperating with one bore each in the wall of the roller.

16 Claims, 2 Drawing Sheets

DEVICE FOR REMOVING FLAT ARTICLES FROM A STACK

FIELD OF THE INVENTION

The invention relates to a device for removing flat articles from a stack, said device comprising at least one roller which contacts the uppermost article of the stack and is rotatable about a shaft and whose circumferential surface is covered by a layer consisting of a resilient material.

BACKGROUND OF THE INVENTION

A rotary removing device for packaging machines has been disclosed in DE-A-40 01 370. Said rotary removing device comprises a plurality of suction cups adapted to remove a semifinished packaging item from a magazine and to feed said item along a transport path for further processing. The suction cups are mounted on a carrier device which is driven for rotation and whose rotary movement is superposed by an oscillating movement such that the suction cups are substantially arrested temporarily at least at the moment when the packaging items are lifted and removed. The rotation of the main shaft causes a vacuum control in response to the angle of rotation. Thus the suction cups can be subjected, at the right moment, to a vacuum for lifting and removing, respectively, such packaging items.

A suction device for removing and transporting x-ray film sheets has been disclosed in DE-A-42 40 015. Said suction device comprises a suction shaft which carries at least one suction member and a number of deflecting rollers, the suction device being pivotable about said suction shaft. The suction members are adapted to suck one x-ray film sheet at a time from a sheet stack and to release such sheet as well. At least one deflection roller is designed such that it projects with its circumferential surface in a direction opposite to the direction of suction. The deflecting roller and its mounting is resilient such that it is in flush contact with the suction member when an x-ray film has been sucked.

Another device for removing sheets from a stack has been disclosed in specification EP-A-0 226 083. In a position opposite to the uppermost sheet of the sheet stack, a rotary roller is provided which is connected with a vacuum means. At least one opening passing through the periphery of said roller is connected with the vacuum means. Moreover a toothed belt driving the roller free from slipping includes bores which are brought into register with the openings in the roller. The suction means thus formed allows a sheet to be lifted from the sheet stack.

SUMMARY OF THE INVENTION

It is the object of the invention to provide a device for removing flat articles from a stack, said device being operable in a simple manner, without complicated control means being required.

Another object of the invention is to design said device such that the influence of friction between said device and the sheet is minimized in order to make said device as independent as possible from the friction parameters between the flat article and the device for removing the flat article.

In accordance with the invention there are provided a plurality of suction cups in the resilient layer of the circumferential surface of the roller, in that the roller is a hollow roller and in that said hollow roller includes a mechanical means by which the suction cups in the resilient layer on the circumferential surface of the roller can be operated by partial deformation of said resilient layer.

The advantage of the device according to the invention is that the flat articles can be transported substantially independently of the friction prevailing between the roller and the flat article. An error source caused by the fact that the roller surfaces are increasingly worn smooth with age is thus minimized. Moreover the device proposed according to the invention does not require complicated control means for lifting and separating the flat articles from the stack.

Another advantage is that the device according to the invention results in that the flat articles are separated from each other and in that a predetermined lifting level is attained while the space requirement of the device is confined to a minimum.

Further advantageous modifications of the invention can be inferred from the subclaims.

BRIEF DESCRIPTION OF THE DRAWINGS

The subject matter of the invention will now be described with reference to the embodiment illustrated in the drawing, wherein.

DETAILED DESCRIPTION OF THE INVENTION

Figure 1:
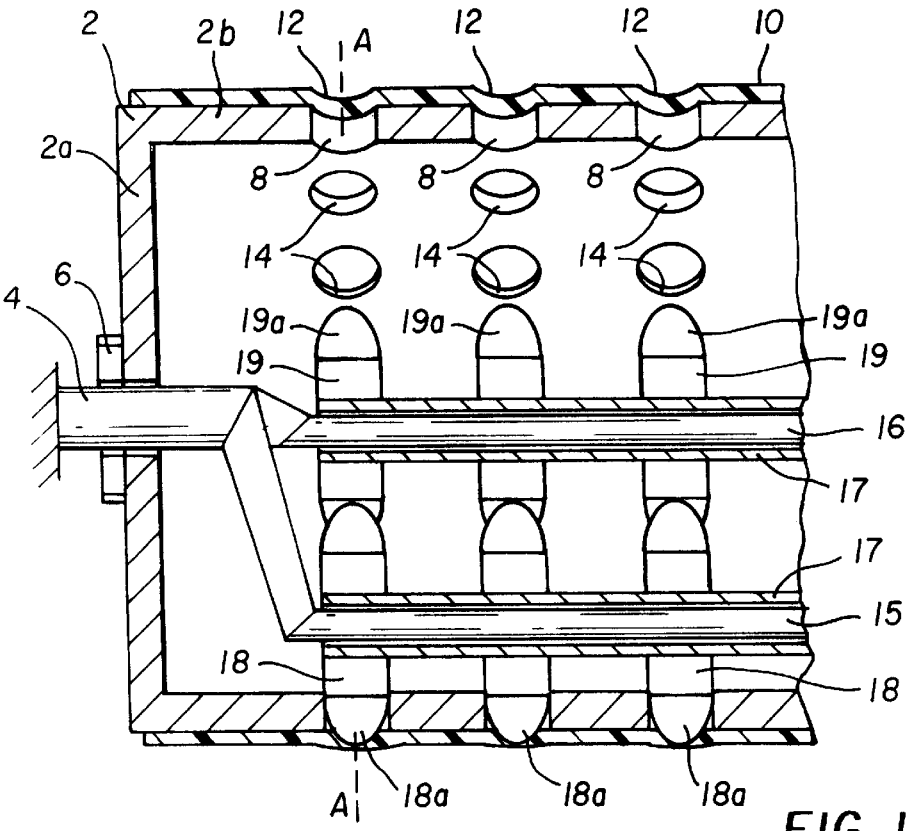
FIG. 1 is a partial cross-section through the roller along the longitudinal axis thereof.

As shown in FIG. 1, a rotary roller 2 is mounted on a fixed shaft 4 and driven from outside by a suitable driving motor (not shown) via, for example, a toothed gearwheel 6. Rotary roller 2 may extend over the total width of the flat articles 20 to be separated. It is also conceivable for roller 2 to be composed of a plurality of roller elements which, together, extend over the total width of the flat articles 20 to be separated. The toothed gearwheel 6 is mounted to one end 2*a* of roller 2 such that it surrounds the fixed shaft 4. Roller 2 is positioned above a stack of flat articles 20 (see FIG. 2). The following description is confined to a stack of paper sheets or foils. However, a person skilled in the art will be readily aware of the fact that the device according to the invention can also be used for separating from a stack other flat articles, such as film sheets, metal foils, cartons and the like.

Sheet stack 20 is positioned in a supply magazine 22 on a stack support 24. Supply magazine 22 consists of a base portion 26 and an abutment edge 28 which is vertically mounted to said base portion 26 and on which the sheet stack is aligned. Between stack support 24 and base portion 26 of supply magazine 22, a spring element 30 is provided by which the sheet stack 20 positioned on stack support 24 is urged into contact with roller 2. The pressure force of spring element 30 is chosen such that independently of the stack height, a pressure force great enough to remove individual sheets from sheet stack 20 is ensured at all times.

Roller 2 is designed as a hollow roller, and wall 2*b* of roller 2 is provided with a plurality of bores 8 which are arranged radially and axially at regular distances from each other. Each of the bores 8 is long enough to extend through wall 2*b* of roller 2. The circumferential surface of roller 2 is covered with a layer 10 made from a resilient material (such as an elastomer or rubber). Layer 10 is provided with cup-shaped depressions 12 whose number corresponds to that of the bores 8. Layer 10 is arranged on wall 2*b* of roller 2 such that the depressions 12 in layer 10 are in register with the bores 8 in wall 2*b* of roller 2. The bores 8 along with the depressions 12 of layer 10 form suction cups 14 distributed at regular distances over roller 2.

Within roller 2, fixed shaft 4 is divided into a first and a second shaft member 15 and 16. Mounted on said first and second shaft members 15 and 16 are tubular shafts 17 on which a first and a second wheel 18 and 19, respectively, with elongate protrusions is mounted for rotation. The elongate protrusions 18*a* of the first wheel 18 and the elongate protrusions 19*a* of the second wheel 19 are received in the bores 8 underlying the depressions 12 of resilient layer 10. As a result of the engagement of the elongate protrusions 18*a* and 19*a*, respectively, the first and the second wheel 18 and 19, respectively, are driven.

The first wheel 18 is the pressure wheel, the second wheel 19 the releasing wheel. The second wheel 19 engages the bores 8 to a greater depth than the first wheel 18. When roller 2 is rotated counterclockwise the first wheel 18 moves in advance of the second wheel 19. In the embodiment shown in FIG. 2, the first wheel 18 is displaced by an angle of 90° from the second wheel. The elongate protrusions 18*a* of the first wheel 18 urge (deform) the resilient depression 12 outwardly, which produces a vacuum when depression 12 is disengaged and thus results in that an uppermost sheet 32 of the sheet stack adheres to the roller. The elongate protrusions 19*a* of the second wheel 19 following the first wheel 18 urge (deform) the resilient depression more outwardly than the elongate protrusions 18*a* of the first wheel 18 (e.g., protrusions 19*a* are longer than protrusions 18*a* ) so that sheet 32 adhering to roller 2 can be released from roller 2.

Figure 2:
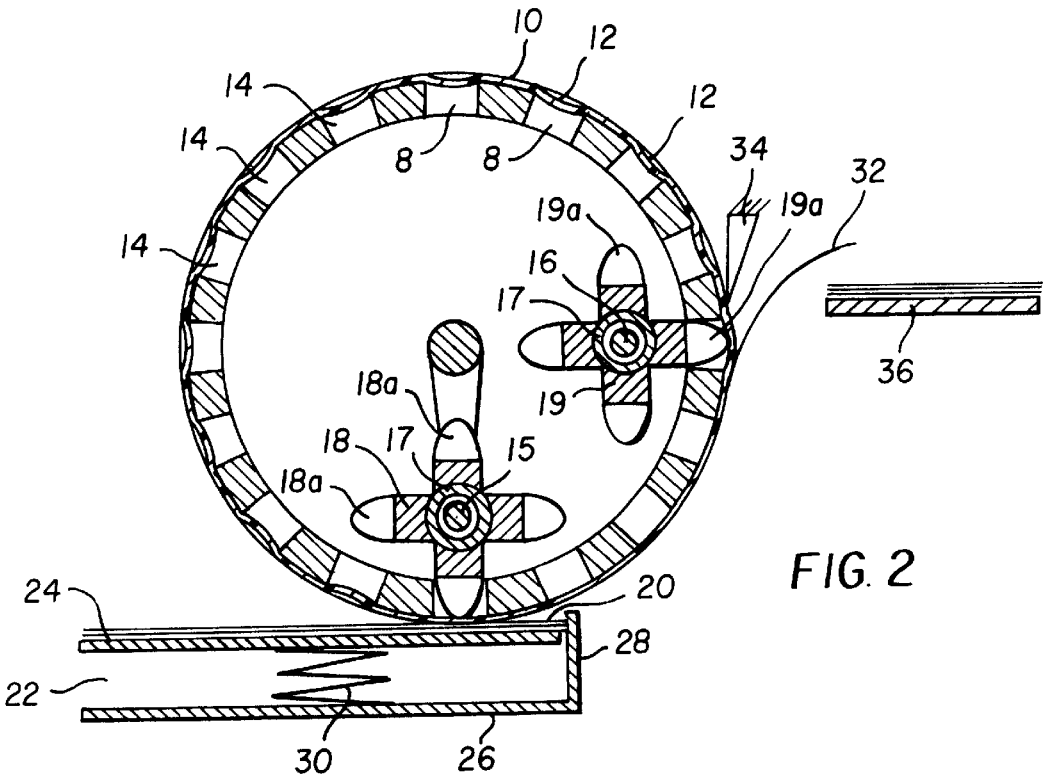
FIG. 2 is a cross-section through the roller along the sectional line A—A illustrated in FIG. 1.

Rotary roller 2 (moving counterclockwise) also drives the first wheel 18 and the second wheel 19 counterclockwise by means of the bores 8 in wall 2*b* of roller 2. Sheet stack 20 is urged into contact with roller 2 by spring means 30. In another embodiment, roller 2 can also be urged into contact with sheet stack 20 which is positioned in supply magazine 22. At the moment when a row of suction cups 14 (bore 8 and depression 12) and the uppermost sheet 32 of the stack surface make contact the elongate protrusions 18*a* of the first wheel 18 (pressure wheel) urge the depression 12 outwardly and against said uppermost sheet (FIG. 2). This produces a vacuum, and the suction cups are thus brought into their contact position. While roller 2 continues rotating the first wheel 18 (pressure wheel) again releases the rear sides of the suction cups. However, as a result of the resiliency of the depressions 12, the suction cups maintain the vacuum between sheet 32 and depression 12 so that the sheet is brought into contact with the surface of the roller and is lifted and removed from sheet stack 20.

The second wheel 19 (releasing wheel) which follows the first wheel 18 is displaced with respect to the first wheel 18 such that sheet 32 is released from the roller surface at the desired transport level. The elongate protrusions 19*a* of the second wheel 19 now once again urge the depressions 12 outwardly whereby the vacuum still present is removed and sheet 32 released.

According to a further embodiment, a stripping device 34 may be provided at a suitable level, such device either replacing the second wheel 19 (releasing wheel) or cooperating with said second wheel 19. Stripping device 32 feeds sheet 32 away from roller 2 so that it can be transferred to a level 36 and further processed.

Figure 3:
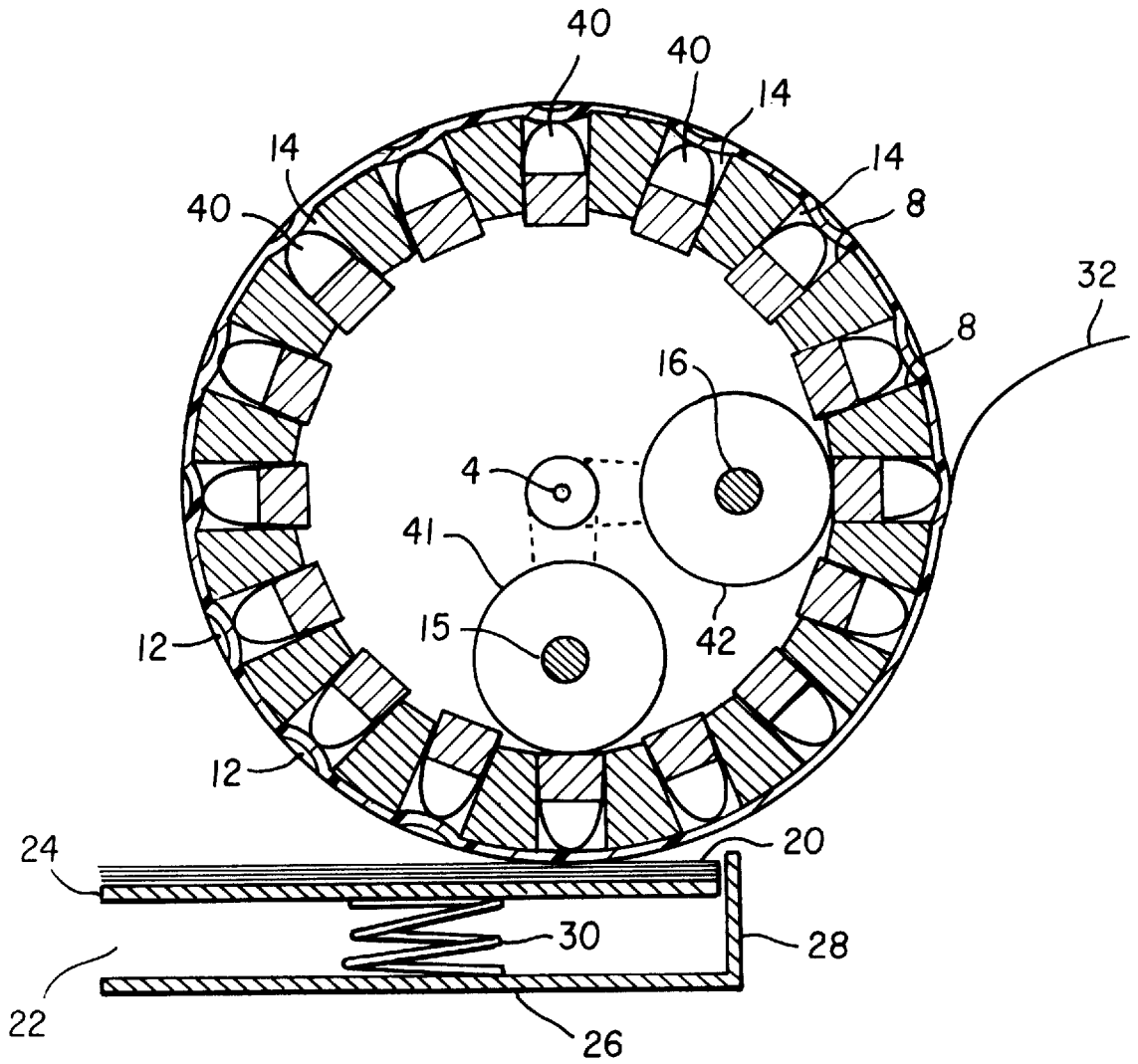
FIG. 3 shows an embodiment adapted for operating the suction cups arranged on the surface of the roller.

In the embodiment illustrated in FIG. 3, pins 40 mounted in suitable guide means (not illustrated) are arranged in the bores 8 of roller 2. The pins 40 are designed in a manner corresponding to that of the elongate protrusions 18*a* as shown in FIG. 1 or FIG. 2. The pins 40 can be prevented from dropping out of bores 8 by a suitable abutment (not illustrated) provided in the guide means or in that the tips of the pins 40 are bonded to the rear sides of the suction cups 14.

Like in the embodiment illustrated in FIG. 2, fixed shaft 4 within roller 2 is divided into a first and a second shaft member 15 and 16. Mounted on the first and on the second shaft members 15 and 16 are tubular shafts 17 on which a first and a second pressure roller 41 and 42, respectively, is mounted for rotation. At the moment when a row of suction cups 14 (bore 8 and depression 12) and the uppermost sheet 32 of the stack surface make contact the first pressure roller 41 urges the pins outwardly. The pins 40 are thus pressed against the suction cups which are tensioned thereby. After they have come to adhere to the sheet the suction cups 14 maintain their vacuum until the second pressure roller 42 once again urges the pins 40 outwardly so that sheet 32 can be released from the surface of roller 2. In the case of this embodiment the pressure rollers 41 and 42 are arranged such that the first pressure roller 41 is displaced by an angle of 90° from the second pressure roller 42.

Further possible applications of the device according to the invention are:

- reversal of the order of sheets in the stack if a new stack is formed immediately on level 36,
- turning of the sheets if they contact the roller over more than 180° before they are released.

The invention has been described with reference to a preferred embodiment. Obviously, however, modifications can be made by those skilled in the art, without exceeding the scope of the following claims.

What is claimed is:

1. Device for removing flat articles from a stack, said device comprising at least one roller which contacts the uppermost article of stack and is rotatable about a shaft, the circumferential surface of said one roller being covered by a layer of a resilient material, a plurality of suction cups provided in said resilient material layer, said one roller being a hollow roller, and said hollow roller having a mechanical means by which said suction cups provided in said resilient material layer can be operated by deformation in the direction outwardly of the circumferential surface of said one roller.

2. Device according to claim 1, characterized in that each suction cup of said plurality of suction cups is provided as a cup-shaped depression arranged over a respective bore defined in a wall of said one roller.

3. Device according to claim 2, characterized in that said mechanical means within said one roller is at least one wheel on which a plurality of elongate protrusions are arranged such that said elongate protrusions influence the depressions of said resilient material layer through said bores in said wall of said one roller and thus operate said suction cups.

4. Device according to claim 3, characterized in that two different wheels with respective elongate protrusions are provided, said first wheel being a pressure wheel and said second wheel being a releasing wheel, and in that said elongate protrusions of said pressure wheel are shorter than said elongate protrusions of said releasing wheel.

5. Device according to claim 4, characterized in that said elongate protrusions of said pressure wheel deform respective depressions of said resilient layer such that a vacuum can be produced between the flat article and said one roller, said vacuum causing the flat article to adhere to said one roller.

6. Device according to claim 4, characterized in that said elongate protrusions of said releasing wheel deform respective depressions of said resilient layer such that the vacuum between the flat article and said one roller, which causes the flat article to adhere to said one roller, can be removed so that the flat article can be released from said one roller.

7. Device according to claim 4, characterized in that said shaft is divided, inside said one roller, into a first and a second shaft member, and in that tubular shafts, on which said first and said second wheel respectively are seated, are mounted for rotation on said first and second shaft members.

8. Device according to claim 7, characterized in that said one roller is drivable via a toothed gearwheel, in that said toothed gearwheel is fixedly connected with an end wall of said one roller and surrounds said shaft, and in that said rotary roller drives said first wheel and said second wheel via bores in said wall of said one roller.

9. Device according to claim 1, characterized in that said one roller extends across the total width of the flat articles to be separated.

10. Device according to claim 1, characterized in that said one roller is composed of a number of roller elements which together extend across the total width of the flat articles to be separated.

11. Device for removing flat articles from a stack, said device comprising at least one roller which contacts the uppermost article of the stack and is rotatable about a shaft, the circumferential surface of said one roller being covered by a layer consisting of a resilient material, comprising a plurality of suction cups provided in said resilient material layer, said one roller being a hollow roller and said hollow roller having mechanical means by which said suction cups provided in said resilient material layer can be operated by deformation in the direction outwardly of the circumferential surface of said one roller, a wall of said one roller defining a plurality of bores, and in each bore of said wall of said one roller, a pin being arranged for radial movement such that said pins are actuated by said mechanical means, which are first and second pressure rollers, so that said pins cooperate with said suction cups.

12. Device according to claim 11, characterized in that each suction cup of said plurality of suction cups is provided as a cup-shaped depression arranged over a respective bore defined in said wall of said one roller.

13. Device according to claim 11, characterized in that said first pressure roller is displaced by 90° from said second pressure roller, and in that said first pressure roller operates said pins along with said suction cups such that the uppermost sheet of a sheet stack adheres to said one roller, and said second pressure roller operates said pins along with said suction cups such that a sheet adhering to said one roller can be released from said one roller.

14. Device according to claim 11, characterized in that said one roller is drivable via a toothed gearwheel, and in that said toothed gearwheel is fixedly connected with an end wall of said one roller and surrounds said shaft.

15. Device according to claim 11, characterized in that said one roller extends across the total width of the flat articles to be separated.

16. Device according to claim 11, characterized in that said one roller is composed of a number of roller elements which together extend across the total width of the flat articles to be separated.

* * * * *